United States Patent [19]

Levy et al.

[11] Patent Number: 4,529,390

[45] Date of Patent: Jul. 16, 1985

[54] INTERACTIVE INFLATABLE BAG TOY

[76] Inventors: Richard C. Levy; Sheryl Levy, both of 6737 Newbold Dr., Bethesda, Md. 20817; Gary Piaget, 5 Ridlely Ct., Glen Ridge, N.J. 07028

[21] Appl. No.: 648,112

[22] Filed: Sep. 7, 1984

[51] Int. Cl.[3] ..... A63H 3/06

[52] U.S. Cl. ..... 446/220; 273/401; 273/26 A

[58] Field of Search ..... 446/220, 221, 222, 223, 446/224, 226, 225; 273/400, 401, 26 A, 55 R

[56] References Cited

U.S. PATENT DOCUMENTS 3,163,419 12/1964 Lemelson ..... 446/220 X 3,680,862 8/1972 Russell et al. ..... 273/55 R

*Primary Examiner*—Robert A. Hafer

*Assistant Examiner*—Daniel Nolan

*Attorney, Agent, or Firm*—Foley & Lardner

[57] ABSTRACT

An inflatable game device comprising an inflatable body including a ballast to maintain the inflatable body in a normal attitude, and including a pocket adapted to receive an object. The pocket is integrally formed with the body and includes a constricted portion to facilitate retention of the object in the pocket once received.

7 Claims, 3 Drawing Figures

INTERACTIVE INFLATABLE BAG TOY

The present invention relates to an inflatable game device, and in particular, to an interactive inflatable toy.

Toys comprising an inflatable body with a sand balast or the like disposed in the base thereof to maintain the body in a normal attitude, e.g., an upright position, when inflated, are well known. Inflatable toys bearing indicia of a sports figure such as a baseball player and including a central pocket adapted to receive or retain a ball are also known. An example of such device is described in U.S. Pat. No. 3,163,419 issued on Dec. 29, 1964 to Jerome H. Lemelson.

Such prior art devices, however, tend to utilize pockets essentially extrinsic to the inflatable body. In the prior art devises, a body is formed in main part by front and rear sheets of flexible plastic material, sealed together, e.g., by welding (heat sealing) at the outer peripheries thereof. Both front and rear sheets include openings, the peripheries of which are also sealed together. A pouch is connected to the body at the opening, and extends rearwardly from the opening rather than forming an integral part of the body. Accordingly, other than receiving the ball, the pouch (pocket) has essentially no interaction with the ball, and tends to permit the ball to escape, particularly, if the momentum of the ball imparts a motion to the inflatable body.

SUMMARY OF THE INVENTION

The present invention provides an inflatable toy including an interactive pocket adapted for receiving and retaining a thrown object. The pocket is integrally formed with the body, specifically configured to conform to the shape and size of the thrown object. Further, the sidewalls of the pocket are biased inward by the air pressure of the inflated body to constrict a portion of the pocket and facilitate retention of the object.

BRIEF DESCRIPTION OF THE DRAWING

A preferred exemplary embodiment of the present invention will hereinafter be described in conjunction with the appended drawing, wherein like designations denote like elements, and.

DETAILED DESCRIPTION OF A PREFERRED EXEMPLARY EMBODIMENT

Figure 1:
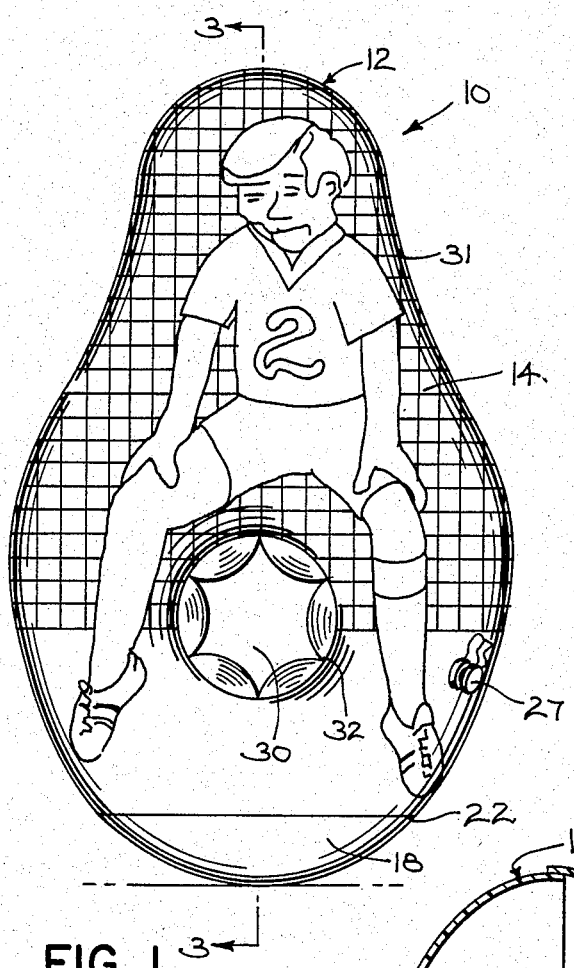
FIG. 1 is a front elevational view of an interactive inflatable toy in accordance with the present invention.
Figure 2:
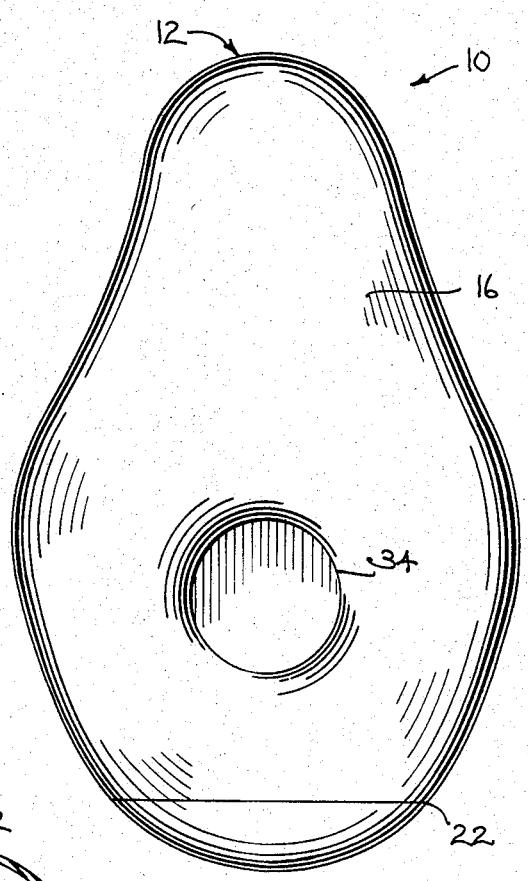
FIG. 2 is an elevational rear view of an inflatable toy in accordance with the present invention.
Figure 3:
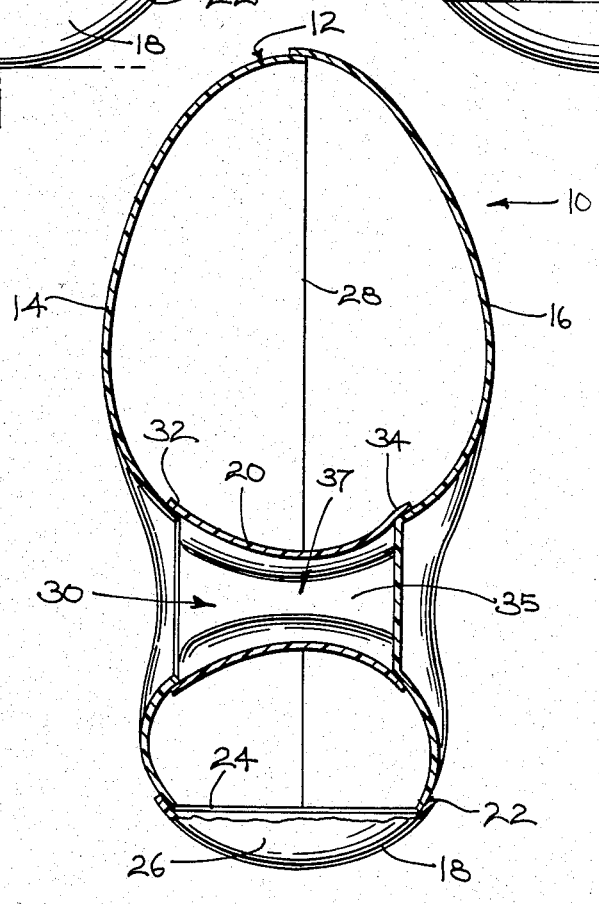
FIG. 3 is a sectional side view of the interactive inflatable toy.

Referring to FIGS. 1, 2 and 3, an interactive inflatable toy 10, comprises a body 12 formed of a flexible plastic sheeting such as flexible polyvinylchloride plastic. Body 12 is formed of respective front, rear, bottom and pocket sections, 14, 16, 18 and 20, respectively (best seen in FIG. 3).

Front section 14 and rear section 16 each comprise sheets of flexible plastic of essentially the same size and shape. Front section 14, however, includes an opening (cut out portion) 30 of a predetermined shape in accordance with the particular object to be received. For example, a round opening would be utilized to receive a baseball, soccer or football, and an eliptical or rectangular opening would be utilized for a flying disc (e.g., Frisbee). The dimensions of opening 30 are slightly larger than the relevant dimensions of the object to be received. As will be explained the portion of front section 14 surrounding opening 30 (and corresponding portion of rear section 16) is flared out to present a wider surface in the vicinity of opening 30. Front section 14 also suitably bears indicia 31 of a sports figure, such as, for example, a soccer, baseball or football player, disposed in predetermined relation with opening 30. For example, as shown in FIG. 1, where inflatable toy 10 is intended to receive a soccer ball, front section 14 may include an illustration of a soccer player appearing to be juxtaposed in front of opening 30, as if guarding a goal. Similarly, a baseball "catcher" or football "receiver" could be depicted on front section 14 with cut out 30 being disposed centrally of a catcher's mit, or between the receiver's hands, respectively.

Pocket section 20, like the front and rear sections 14, 16, is suitably formed of a single sheet of flexible plastic material sealed at respective edges to form a tube. A plurality of sheets of material may be seamed, as necessary, to provide pocket configurations to accommodate various objects.

Front section 14 and rear section 16 are each sealably fastened, i.e., welded (heat sealed) to bottom portion 18 along seam 22. An interior partition 24 for maintaining a balast material 26 is similarly fixed to either bottom section 18 or to front section 14 and rear section 16. If desired, partition 24 can be an integral portion of bottom section 18.

Front section 14, rear section 16 and pocket portion 20 (and bottom section 18) cooperate to form a closed area, which may be pressurized through a valve 27 (FIG. 1) to inflate body 12.

The side and top edges of front section 14 and back section 16 are sealed together by, e.g., welding (heat sealing) along seam 28 (FIG. 3) to form thereby the outer walls of body 12. The "inner" walls of body 12 are formed by pocket section 20. The front periphery of pocket section 20 is sealably fastened, e.g., welded (heat sealed) along the periphery of opening 30 at seam 32. The rear periphery of pocket section 20 is sealably fixed to the interior of rear section 16, forming a seam 34. Thus, a portion of rear section 16 forms a rear end wall for the pocket formed by pocket section 20.

Pocket section 20, sealably fixed to front section 14 and rear section 16, forms, when body 12 is inflated, a semi-rigid pocket 35 with a constricted portion 37 at a point in accordance with the relative configurations and dispositions of seams 32 and 34. The dimensions of opening 30 are chosen to be slightly larger than the object to be received. The configuration of seam 34 coupling tunnel section 20 to rear section 16 is formed with a similar configuration, again, slightly larger than the object to be received. Seam 34 suitably defines an area approximately the same size as cut out 30. However, the rear portion of the pocket can be made larger or smaller, as desired by varying the configuration of seam 34. Likewise, seams 32 and 34 are suitably disposed at substantially the same distance from base 18. However, the relative heights can be varied to accommodate objects directed at body 12 from an angle. For example, seam 34 can be disposed slightly higher than opening 30 to accommodate soccer balls kicked from ground level. As will be explained, constriction 37 in pocket 35 prevents escape of the ball, and thus permits such tilting of pocket 35.

Inflation of body 12 biases pocket section 20 towards the interior of the tunnel, causing a constriction in the width of the tunnel at a point 37 determined by the relative configurations of seams 32 and 34. When an object, e.g., a ball, is received in the tunnel, easy admittance is gained through opening 30. However, the constriction in the tunnel comes into contact with the ball, slowing the ball down. The ball presumably passes through the constriction and is retained in the rear portion of the tunnel. The constriction prevents the ball from escaping the tunnel once it is entered, i.e., the constricted portion of the tunnel prevents the ball from bouncing out upon impact against the rear wall of the tunnel.

Further, a pocket section 20 interconnecting the front and rear sections 14, 16 of the body, causes relatively little distortion to the inflated shape of front section 14, as is the case in the prior art where the front and back sections are seamed together to form the interior body wall and a separate slack sheet of material used to form the pocket. Thus, the illustration 31 depicted on front section 14 is relatively undistorted.

Body 12 is flared out, i.e., is wider across the front and rear in the vicinity of the tunnel. Thus, a larger field is provided around the tunnel entry. Thus, particularly in view of the relatively small amount of distortion in the shape of body 12 due to the presence of the pocket, it is relatively likely that the ball will be bounced directly back to the thrower, as if off a wall, in the event of a miss.

It will be understood that the above description is of a preferred exemplary embodiment of the present invention, and that the invention is not limited to the specific form shown. Modifications may be made in the design and arrangement of the elements without departing from the spirit of the invention as expressed in the appended claims.

What is claimed is:

1. In a toy of the type including an inflatable body, said body having a pocket for receiving and retaining an object propelled thereat, and means for defining a normal body attitude with the body inflated, the improvement wherein:

said body comprises front, rear and pocket sheets of flexible material, and a base; said front sheet including an opening therein;

the outer periphery of said front and rear sheets being sealed together and to said base, and said pocket sheet being a continuous tubular sheet having a first circumference at one end sealed to said front sheet about said opening and a second circumference at its opposite end sealed to the interior of said rear sheet to cooperate with said front and rear sheets to form said inflatable body and said pocket;

said pocket having an access defined by said front sheet opening, sidewalls defined by said pocket sheet extending between said first and second circumferences, and a rear wall defined by said rear sheet closing said second circumference.

2. The toy of claim 1 wherein said sidewalls constrict a portion of said pocket when said body is inflated.

3. The toy of claim 1 wherein the portion of said front and rear sheets proximate to said pocket are wider than other portions of said front and rear sheets.

4. The toy of claim 1 wherein said base comprises a base sheet of flexible material sealed to the lower periphery of said front and rear sheets.

5. The toy of claim 2 wherein said base comprises a base sheet of flexible material sealed to the lower periphery of said front and rear sheets.

6. The toy of claim 3 wherein said base comprises a base sheet of flexible material sealed to the lower periphery of said front and rear sheets.

7. The toy of claim 1 wherein said means for defining a normal attitude for said body when inflated comprises a balast material disposed in said base.

* * * * *